United States Patent [19]

Dente et al.

[11] Patent Number: 4,459,200

[45] Date of Patent: Jul. 10, 1984

[54] RECOVERY OF HYDROCARBONS FROM TAR SANDS

[75] Inventors: Mario Dente, Milan; Livio Antonelli, Rome; Carlo Gallazzi, Bergamo, all of Italy

[73] Assignee: Ingeco International S.A., Lugano, Switzerland

[21] Appl. No.: 372,382

[22] Filed: Apr. 27, 1982

[30] Foreign Application Priority Data

May 5, 1981 [IT] Italy ..... 21727 A/81

[51] Int. Cl.[3] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS

| | | | |
|---|---|---|---|
| 3,041,267 | 6/1962 | Frame et al. | 208/11 LE |
| 3,509,037 | 4/1970 | Tse | 208/11 LE |
| 3,526,585 | 9/1970 | Camp | 208/11 LE |
| 3,558,469 | 1/1970 | White et al. | 208/11 LE |
| 4,017,377 | 4/1977 | Fairbanks et al. | 208/11 LE |
| 4,110,194 | 8/1978 | Peterson et al. | 208/11 LE |

FOREIGN PATENT DOCUMENTS

| | | | |
|---|---|---|---|
| 917586 | 12/1972 | Canada | 208/11 LE |

*Primary Examiner*—Delbert E. Gantz
*Assistant Examiner*—A. Pal
*Attorney, Agent, or Firm*—Holman & Stern

[57] ABSTRACT

The process for the substantially total recovery of hydrocarbons from oil sands comprises:

Preconditioning of the sands with diluent, possibly water (which may also be recycled from the process) and, preferably, with recycle extract; digestion of the homogeneous pulp, with (process) water; a first separation of the water-sand suspension from the hydrocarbon phase and from the digestion water; simultaneous washing and mixing of the solids separated from the bulk of the hydrocarbon phase in thick phase with overflowing water; a possible second separation of the dense solid mass from the excess liquid phase, the intermediate aqueous layer from the first separation (middlings) undergoing decantation and thickening and the solids so thickened undergoing centrifugation and stripping for the recovery of the limited proportions of diluent entrained with it. The equipment for this process consists of a preconditioner, a digestor, a first separator, a thick phase mixer, a possible second separator, a decanter-thickener, a centrifuge and a stripper, besides the possible apparatus for treating the diluted bitumen.

17 Claims, 1 Drawing Figure

RECOVERY OF HYDROCARBONS FROM TAR SANDS

BACKGROUND OF THE INVENTION

1. Field of the Invention

This invention relates to a process for the substantially full recovery of the hydrocarbons contained in solid bituminous minerals, in which the mineral sands undergo at least one digestion stage and subsequently one or more separations of solids and liquid layers, the latter being treated in turn and at least part recycled to the process. As known with the continuous increase of the petrol price the exploitation of the extensive deposits of tar sands or similar products, discovered in Canada, USA, Venezuela, Madagascar, etc., and consisting mainly of siliceous material impregnated with heavy and low API grade viscous hydrocarbons, has become an attractive alternative in the production of synthetic oil.

2. Description of the Prior Art

Many processes have been proposed for the treatment of tar sands such as: hot water processes, cold water and solvent processes, solvent only processes (see f.i. Canadian Pat. No. 611,587 U.S. Pat. No. 3,875,046 etc.)

The hot water processes, various problems notwithstanding, are currently used to extract bitumen from the Canadian sands of Athabasca, but fail when viscosity of the hydrocarbon to be recovered is too high or when the tar sands have, either originally or as a result of aging, a low interstitial water (known in technical jargon as "connate water") content.

Another disvantage of hot water processes is the production of a discharge stream (middlings) containing fines (generally $<44\mu$) and emulsioned hydrocarbon, which must be sent to tailing ponds outside the plant, thus presenting a serious economical and ecological problem and increasing energy consumption for the entire process.

Solvent processes, on the other hand, have always had the disadvantage of solvent losses so extensive as to render the process economically non viable. The phenomena of disaggregation of lumps of oil sand and of detaching the bitumen from the sand grains are dominated by two main parameters: the connate water content in the tar sands and the viscosity of the hydrocarbon to be recovered.

If the layer of connate water between the sand grains aggregate and the bitumen which mostly fills the cavity is sufficient, such connate water acts as lubricant during separation of the hydrocarbon.

In this case it is sufficient to operate above the hydrocarbon softening point (acting on the temperature, for example) to cause the separation, the hydrocarbon viscosity having a minimal influence on the speed (rate) of separation.

When, on the other hand, the layer of connate water is not sufficiently thick to provide adequate lubrication, the speed (rate) of hydrocarbon separation from the sand grains aggregate is almost entirely subject to the viscosity of the hydrocarbon itself.

This viscosity may be reduced, in these cases, by operating at a higher temperature and/or by adding as diluent a less viscous hydrocarbon, but in any case it is costly both in terms of energy and of diluent consumption.

In two recent Italian Patent Applications (No. 67236 A/80 corresponding to published European Patent Application 0034896 and No. 63438 A/80) Applicant and its affiliate RTR Rio Tinto have described a treatment for heterogeneous liquid materials and a complete process for the extraction of bituminous oils.

SUMMARY OF THE INVENTION

Continuing its research in this field now the Applicant has devised a process comprising a combination and a succession of treatment steps successfully and critically coordinated between them, operating conditions of each single step being very specific in themselves and very closely connected to those of the other steps, so as to achieve an overall treatment offering optimum performance, i.e. maximum recovery of hydrocarbon from the sands with a minimum consumption of diluent, water and energy, reducing to an acceptable level the problems created by tailings and effluents.

The process according to the invention is characterized by the fact that it consists of:

1.A) a preconditioning stage (PREC) of the tar sands with recycle extract and possibly with water or aqueous liquid in a ratio lower than 0.3 (by weight on the sand weight) and with a liquid diluent hydrocarbon at a moderately high temperature and for a period long enough to reach the full disaggregation of the solid material and its homogenisation in the hydrocarbon phase;

2.B) a digestion stage (DIG) in which the obtained homogeneous pulp M-H-P is treated with a quantity of process water having a pH between 7.5 and 10.5 in a weight ratio (on the preconditioned mass solids) not lower than 0.3, at a temperature even slightly below that of the preconditioning, and for a period sufficiently long to permit the impregnation of all the solids, the almost total displacement of the hydrocarbon phase from the solid mass and the possible formation of an aqueous layer between the thickened solid layer (S-DIG) and the floating hydrocarbon phase I-DIG which is thus directly recovered;

3.C) preferably a stage of screening (VAG);

4.D) a stage of separation (SEPA) of the thickened solid product obtained from the digestion stage possibly mixed with a portion of the upper water layer or with process water (but free from most of the hydrocarbon phase), in which the solid part is sedimented by gravity to the bottom and a hydrocarbon phase and an aqueous layer containing fines and a minimal hydrocarbon content are separated;

5.E) a mixing (washing) stage in thickened phase (MFA) in which the solids recovered in the separation stage are intensively but slowly and evenly mixed in co and/or counter-current with process water under conditions favorable to the coalescence of the hydrocarbon droplets, to their growth and their being entrapped by the washing water running on the surface of the thickened phase and recycled to the process as, for example, digestion water;

6.F) preferably, a final separation stage (SEF) of the solids coming from mixing in thickened phase in which the solids are sedimented by gravity and discharged directly to their dump, while the water layer is recycled to the process;

7.G) a decanting-thickening treatment (DIS) of the aqueous layer produced in separation under 4.D)

and possibly of aqueous streams coming from other sources, in which fines and clay are eliminated from the water which is thus clarified and recycled, and in which such solids are thickened, centrifuged and steam stripped, the liquid obtained by centrifugation as well as the steam from stripping and containing also residual diluent being recycled to the process.

During stage 1.A) if necessary the water could be missing. Any residual clay lump would then remain undigested and could thus be separated by screening together with the other thin material of large enough size. The lumps so separated can be easily washed with water in order to recover the extract dispersed over them. During stages 2.B and 5.E) it is essential to avoid running through the water-oil interface. According to an advantageous aspect preconditioning is carried out at a temperature of 50°-100° C., preferably 65°-85° C., digestion at a temperature of 55°-95° C. preferably 60°-80° C., preconditioning temperature being maintained or corrected by the steam recovered from the stripping stage or by the recycled extract; preconditioning and digestion take place during a period lasting between 3 and 45 minutes.

In a preferred embodiment, digestion takes place in 5' to 15', with a water weight ratio of 0.30 to 1.5 to solid weight, the pH of such water ranging between 8.5 and 9.5.

The plant, according to the invention, comprises: a preconditioner (1), a digestor (2), a possibly screen (3), a first separator (4), a thickened phase mixer (5), a possible second separator (6), a decanter-thickener (7), a centrifuge (8), a stripper (9), as well as the possible equipment for treating the diluted bitumen (10).

BRIEF DESCRIPTION OF THE DRAWING

The attached drawing (FIG. 1) is a flow sheet showing an embodiment of this invention.

The various aspects and advantages of the process and plant according to the invention will be more readily understood from the following description of the embodiment of said FIG. 1 which is simple and compact and, therefore, preferred (though not limitative).

DETAILED DESCRIPTION OF THE INVENTION

Figure 1:
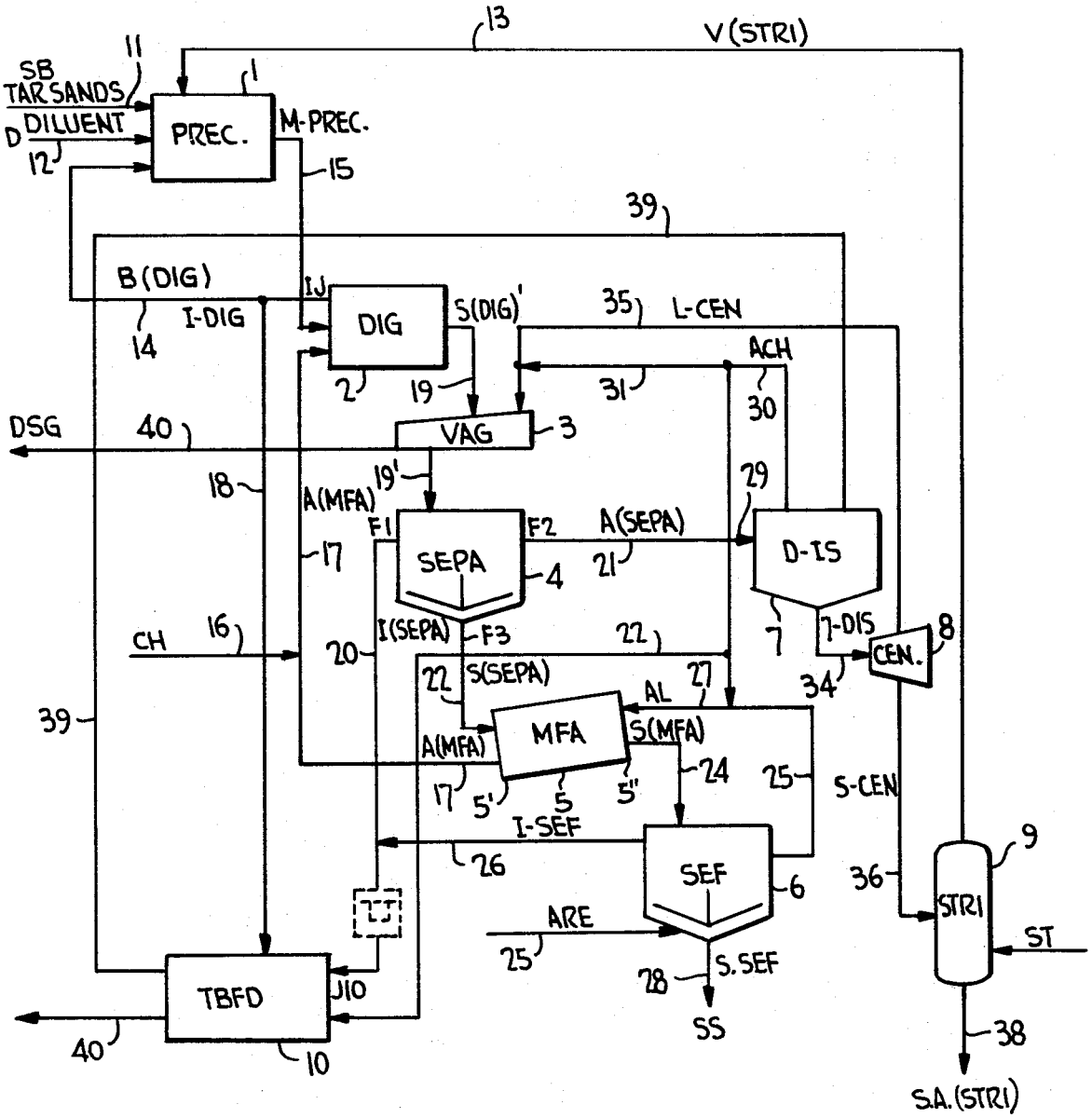

Since the process consists of a combination and succession of stages operating under critically coordinated conditions, it seems opportune to describe in detail each single treatment step.

1.A) Preconditioning (PREC)

The tar sand undergoes initially the preconditioning PREC, carried out under critical conditions. In effect, it has been found that to detach completely the bituminous hydrocarbon from the sand grains in a relatively short time and at a moderate temperature, it is essential for the preconditioning to take place in the presence of a fresh diluent D (introduced through tube 12), and possibly of water, (which may be aqueous recycled liquid), and of hydrocarbon extract B(DIG) (fed through line 14).

To control the temperature, steam V (STRI) can be advantageously used (introduced, for example, directly through tube 13 or another indirect circuit preheating the diluent D or extract B-DIG).

The quantity and composition of these three elements must be carefully selected. In effect a minimal amount of water must be used, since an excess of water in the preconditioner (1) would impair mixing efficiency and contact between hydrocarbon diluent and the tar sand, hindering the full homogeneisation of the diluent with the hydrocarbon bitumen. In addition, too large an amount of water could lead to the formation of three distinct phases inside (1): a thickened solid phase, a floating hydrocarbon phase (mainly diluent) and an intermediate aqueous phase between solid and diluent phases. This would greatly restrict contact between hydrocarbon diluent and solids, practically destroying the effect of the diluent. Besides, the water could disperse in the hydrocarbon; it could eventually even be eliminated. It is, therefore, necessary for the material inside the preconditioner (1) to remain in an homogeneous pulp phase or at most with only the hydrocarbon phase being free.

To this purpose the tar sand SB (fed on line 11 which could be, for example, a screw feeder or a conveyor belt) must be of such size as to be easily treated and to ensure full homogenisation of the solid-liquid and hydrocarbon phases within a reasonable time.

Where unconsolidated tar sands with a high connate water content are concerned, their size should not be more than 0.5 meter, while consolidated tar sands without connate water should be ground down to a few millimeters (2-3 mm). The hydrocarbon diluent D must be fairly light so as to be miscible with the hydrocarbon which, at economically viable concentrations, keeps viscosity and density sufficiently low; it is usually selected between naphtha, kerosene or intermedial distillates. The amount of fresh diluent D depends on its type, the type of sand, the size of the latter, the amount of extract B (DIG) recycled from the digestion stage DIG to PREC, and on temperature.

Extract B (DIG) fed from line 14 is preferably that recovered from the subsequent treatment stage (digestion) and consists, therefore, of diluted bitumen. Fresh diluent D only or the mixture of diluent (D) and diluted recycle bitumen B (DIG) must be in weight ratio (to said sand SB) not lower than 0.15. This ratio is preferably comprised within 0.2 and 0.4. Where water is present it must be in a ratio 0 to 0.2 with the sand. Residence time of the mixture in preconditioner (1) is generally between 2 and 30 minutes, and preferably between 3' and 10'.

As mentioned before, the ingredients and conditions for the preconditioning stage are so selected as to achieve a reduction of the viscosity and density of the bitumen and a full homogenization of the phases at appropriate temperatures and times. To this end it may be advantageous to utilize steam V (STRI) from line 13 to modify the temperature in (1) at an interval of between 50° C. and 100° C. and to maintain it, at any event, above the softening point of bitumen. Obviously said steam V (STRI) may also be used to preheat diluent D and/or the recycle extract B-DIG.

In a preferred embodiment, steam V (STRI) is recovered from a successive stripping treatment STRI.

Preconditioner (1) is preferable of the rotating drum type with internals so designed as to ensure a thorough mixing and heating of the phases and so that residence times, which can be varied according to the size of the tar sand aggregates, can be controlled. Not without surprise, it has also been found that preconditioning PREC carried out under the critical conditions described above, conditions the specifications of the fines in the treated sand in such a way that their separation from process waters and from hydrocarbons (as more clearly described further on) is not only possible but feasible by simple decantation under particularly easy conditions and in a short time, thus solving one of the most critical problems in the conventional processes for the treatment of bituminous sands.

2.B) Digestion

As a result of the preconditioning PREC, carried out under the specific conditions described above, a homogeneous mass M (PREC) is obtained in the absence of water and taken to the digestion treatment DIG, shown schematically by digestor 2, through feed line 15.

In this treatment (also carried out under critical conditions) the previously conditioned mass M-PREC is treated with water, preferably with aqueous liquid A (MFA) recycled from successive process stages and in particular from the mixing treatment in thickened phase MFA. Since this water or aqueous recycle liquid A (MFA) fed through line 17 must displace the greater part of the useful hydrocarbon phase from the solid/liquid homogeneous mass M-PREC, the quantity and composition of the water or aqueous additioned liquid A (MFA) must be such as to imbibe all the solids and, if necessary, form an intermediate aqueous liquid layer between thickened solids and floating hydrocarbon phase. The purpose of digestion DIG, therefore, is to lift and mix the solids, without, however, allowing them to run through the final extract-water interface being formed. To this end it has been found that:

(a) the quantity of water to be fed must be in a weight ratio with the solids present in M-PREC not lower than 0.3, better 0.4; it is preferably in a ratio not higher than 3; (b) for reasons of economy it is preferable for the water used to be that coming from the subsequent thickened phase mixing stage MFA (through 17); (c) the temperature is advantageously a few degrees lower than that of PREC and it is, for example, comprised between 45° and 95° C.; (d) the pH of the aqueous recycle liquid A (MFA) must be between 7.5 and 10.5, better between 8.5 and 9.5, and to this purpose chemicals CH can be introduced to control the pH, such as caustic soda, sodium silicates and alike, fed to line 17 through line 16 (from a source not shown); the aqueous recycle liquid possibly additioned with pH regulators CH, is indicated by A (MFA)'; (e) mixing the recycle liquid A (MFA)' with the digested mass M-PREC must be efficient but gentle to avoid dangerous emulsions between hydrocarbon (extract) and water; (f) the residence time of the solids inside digestor 2 ranges between 3 and 45, preferably between 5 and 15 minutes; (g) the separation of the hydrocarbon phase from the water-impregnated solid phase may take place inside digestor 2 and in this case the hydrocarbon phase I-DIG coming from, for example, from line 14 is sent separately to the subsequent treatment; preferably a smaller part of I-DIG is recycled as aqueous liquid B (DIG) to preconditioner 1 through 14 and a greater part I-DIG is sent through 18 to the final treatment of diluted bitument TFBD in 10; (h) the solid water-impregnated stream S(DIG) has previously undergone by preference screening VAG through a screen which could be upstream DIG to eliminate the largest solid lumps discharged into coarse solids dump DSG through line 40. Digestor 2 may also be of the rotating drum type or a screw mixer according to the size required and to the exigencies of mechanical erection.

3.C) Screening (VAG)

Preferably a stage of screening (VAG) separates the largest pieces contained in line 19, by using the screen 3.

4.D) Separation (SEPA)

The solids water-impregnated S (DIG)' coming from the screen 3 through line 19', undergo now a real separation treatment SEPA (for instance in a separator 4), into three phases; $F_1$, a hydrocarbon phase I (SEPA), recovered from the upper part of vessel 3, which forms the stream of diluted bitumen obtained by separation and is sent through 20 to the final diluted bitumen treatment TFBD in 10; $F_2$, an intermediate aqueous phase which substantially consists of water containing fines and clay, and a small amount of residual hydrocarbon: this aqueous phase A (SEPA) recovered from an intermediate point through line 21, is sent to a decanting and thickening treatment of the decanted solid phase D-IS in 7; and $F_3$, a solid thickened phase S (SEPA) consisting of sand containing water and residual hydrocarbon, which is sent through line 22 to a mixing treatment in thickened phase MFG in the presence of an aqueous overfloating washing phase AL.

5.E) Treatment of mixing in thickened phase MFA

Solids $F_3$, i.e. S (SEPA), which at this stage may still contain an unreleased part of hydrocarbon, entrained by the solids towards the bottom, undergo a mixing treatment MFA in thickened phase in order to facilitate both the coalescence of the hydrocarbon droplets and the release of the hydrocarbon itself, which would otherwise be discharged with the solids.

In order to improve the efficiency of this treatment, solid S(SEPA) coming from the bottom of separator 4 is fed through 22 for instance to device 5 which can be a modified screw or a specially designed rotating drum, arranged horizontally or better still with a slight inclination of the longitudinal rotation axis.

Solids S (SEPA) enter (f.i.) the lowest end 5' of device 5 and undergo, in thickened phase, an intensive but slow and gentle conditioning of the solid mass. Washing water AL is fed to device 5 co- or countercurrently to solids S (SEPA) at (f.i.) at the upper end 5'' and/or at several points (not shown) along the (inclined) longitudinal axis of the device.

This achieves two objectives: the hydrocarbon droplets entrapped in the thickened solids, by appropriate conditioning coalesce and increase in size and owing to their different density and by reason of appropriate conditioning spontaneously rise to the free surface of the thickened solids. Washing water AL then entraps such hydrocarbon droplets, releases them from the solid mass and entrains them outside the process.

The stream of washing water AL may be part of the process make-up water just as some process water recycle stream where such stream is sufficiently free from hydrocarbons and solids. By using part or all of the make-up water at this stage of the process further heat can be recovered from the solid stream being discharged. Preferably washing water AL is used, coming through 23 from final separator SEF (6).

To make this treatment (MFA) more efficient, conditioning of the solid phase must be carried out on an appropriate scale so as to ensure the coalescence of the hydrocarbon droplets present in the thickened solid phase and their increase in size until they can rapidly rise in the aqueous phase.

According to a feature of treatment MFA, conditioning is carried out so that the solids S (SEPA) are kept in the thickened phase without being dispersed with an excessive and unnecessary liquid phase (AL); besides, conditioning itself is carried out so that the surface of the solid bed exposed to the overfloating aqueous phase (AL) is renewed enough times to permit the droplets, increased in size by coalescence, to separate by floating.

According to a further feature, through these operations most of the fines hindering coalescence, hence hydrocarbon recovery, are removed. It has also been found important for conditioning to maintain a continuous separation between the thickened solid phase S (SEPA) and the overfloating washing water aqueous phase AL; i.e., the solid phase must not be allowed to run through the water oil interfaces. The quantity of washing water AL added at this stage is not critical, but it should at least be sufficient to ensure a good displacement of the impregnation water fed with the solids and to provide a continuous liquid layer over the thickened solid phase.

When counter-current is practised, the final section of apparatus 5 near discharge outlet 5'' for sand S (MFG) will ensure, in the absence of washing water, a final squeezing of the solids.

As the drawing shows, with treatment MFA liquid stream A (MFA) is recovered and through 17 and with the prior addition of chemical CH from 16, it is recycled to the digestion DIG.

6.F) Final separation SEF

The drained and washed sand S (MFA) coming from the previous treatment MFA and leaving from one end of apparatus 5, undergoes final separation treatment SEF, for instance in a separator 6 to which said sand S (MFA) is fed through 24, and make-up water ARE are through 25.

In this treatment are recovered: (1) the remaining part of hydrocarbon I-SEF extracted by coalescence in MFA, sent through 26 to the final treatment stage for diluted bitumen TFBD in 10; (2) washing water AL, recycled through 27 to the MFA stage; (3) the drained sand S (SEF) which through 28 is sent to the dump or sand container SS which can be an area outside the plant or an area where deposits have already been exploited; (4) a good portion of the sand heat which is recovered and recycled through aqueous stream AL and possibly other streams from other process points.

(7-8-9) Decanting-Thickening (D-IS)-Centrifugation CEN and stripping (STRI)

The aqueous stream A (SEPA) obtained in the separation treatment (SEPA) is sent through 29 to a treatment for its recovery and for the elimination of fines and clay D.IS. The last remaining minimal quantity of hydrocarbons could possibly be recovered from said stream. This depends on the type of sand treated. In the simplest instance this D.IS treatment includes:

- sedimentation and thickening by decanting of the fines and clay lumps (this substantial operation is greatly facilitated and economical owing to the successful conditioning of the fines during the digestion stage DIG);
- recycling to the process the clarified water ACH via 30, partly to separator 4 via 31 (possibly through screen VAG), partly to treatment MFA through 33 and partly to the treatment of diluted bitumen TFBD through 22;
- centrifugation CEN of solids S. DIS recovered from the bottom of thickener 7 and taken through 34 to centrifuge CEN.

For less simple cases it is advantageous to modify the pH of the aqueous stream A (SEPA) in order to achieve the optimal elimination of clay, using for example chemicals CH; by preference the pH of A (SEPA) is brought to within 3 and 6.

Modification of the pH is followed by flocculation of the solids and of part of the hydrocarbon (remaining in the water stream containing fines and clay A-SEPA); the solids S-DIS recovered from the bottom of 7 are then centrifuged in CEN. The clarified water ACH will be recycled to process after a last modification of the pH to bring it back to 8-9.

The liquid recovered from centrifugation L-CEN is also recycled via 35 to the separator 4 (or is added to stream ACH).

According to a feature of the invention, losses of diluent D are minimized thanks to a stripping treatment of the thickened solids S-CEN fed via 36 to stripper 9 in which steam ST coming from an outer source (not shown) is injected through 37. Fines and clay S-A(STRI) are discharged from the bottom via 38 while stream V which has stripped diluent D is returned to preconditioner 1 via line 13 (unless used to heat diluent D and/or extract B DIG).

10. Possible final treatment of the diluted bitumen TFBD

The major portion of the recovered hydrocarbon is that (I-DIG) obtained from the digestion DIG; this product is practically sand-free and contains limited amounts of water. The solids possibly contained in I-DIG are, therefore, easily decanted so that stream I-DIG may be sent directly to the recovery of diluent D.

On the other hand phase $F_1$, which is the hydrocarbon phase I(SEPA), formed by the heavy hydrocarbon extracted from the tar sands SB and by hydrocarbon diluent D, is discharged from the top of separator 4.

Said hydrocarbon phase I (SEPA) may contain solids and water and preferably undergoes alone an intermediate treatment shown as TI to eliminate water and fines before going together with the other major hydrocarbon stream I-DIG to diluent recovery (not shown).

In the event of the plant using the extracted bitumen requires particularly low fines and water contents, both I-DIG and I-SEPA streams would be joined and receive treatment TFBD in 10, preferably carried out by washing the whole of hydrocarbon phase I-DIG+I-SEPA with hot water, for instance ACH coming from D-IS through 32, according to the disclosure of the published European Patent Application No. 0034896. Same treatment can, however, be applied with other technologies known per se, f.i. by natural decantation of the water and of the therein contained solids, during a time period (f.i. of at least 30 minutes) in a pond or in a decantation apparatus; the sedimented product so obtained (containing solids water and small traces of hydrocarbons) is directly sent to centrifugation CEN (8) together with stream 7-DIS from DIS. Otherwise, especially when operating according to said European Patent, same treatment TFBD includes:

- contacting of hydrocarbon phase I-DIG+I-SEPA with a hot water washing stream;
- separation of the treated hydrocarbon from the dirty washing water;

recycle of the washing water to process, for instance through 39 in D-IS;

discharge of the recovered hydrocarbon in 40.

The following table sets out the material balance obtained from the experimental data resulting from the different stages and process lines according to FIG. 2; figures and symbols in table heads are, therefore, those of said FIG. 1.

The balance refers to consolidated tar sands already milled, with a fines content of about 5%.

| | 11 | 12 | 13 | 14 | 15 | 16 | 17 | 18 |
|---|---|---|---|---|---|---|---|---|
| Diluent | — | 41.84 | 0.36 | 5.4 | 47.6 | | 2.7 | 33.6 |
| Bitumen | 21.7 | — | — | 2.7 | 24.4 | | 1.35 | 16.8 |
| Water | 8.3 | — | 7.7 | 1.7 | 17.7 | | 252.9 | 10.6 |
| Solids | 247.0 | — | — | 0.2 | 247.2 | | 10.5 | 1.2 |
| Total | 277.0 | 41.84 | 8.06 | 10.0 | 336.9 | | 267.45 | 62.2 |

| | 19 | 20 | 21 | 22 | 23 | 24 | 25 |
|---|---|---|---|---|---|---|---|
| Diluent | 11.3 | 7.7 | 2.0 | 3.4 | — | 0.7 | — |
| Bitumen | 6.25 | 3.75 | 1.0 | 2.4 | — | 1.05 | — |
| Water | 258.3 | 1.5 | 282.1 | 107.5 | 230.1 | 84.7 | 55.24 |
| Solids | 256.3 | 0.5 | 18.2 | 240.62 | 4.68 | 234.8 | — |
| Total | 532.15 | 13.45 | 303.3 | 353.92 | 234.78 | 321.25 | 55.24 |

| | 26 | 27 | 28 | 29 | 30 | 31 | 32 |
|---|---|---|---|---|---|---|---|
| Diluent | 0.26 | — | 0.44 | | — | — | — |
| Bitumen | 0.41 | — | 0.64 | | — | — | — |
| Water | 0.1 | 84.2 | 59.32 | | 325.6 | 116 | 60.02 |
| Solids | 0.02 | 1.68 | 233.1 | | 6.2 | 2.32 | 1.3 |
| Total | 0.79 | 85.88 | 293.5 | | 331.8 | 118.32 | 61.32 |

| | 33 | 34 | 35 | 36 | 37 | 38 | 39 | 40 |
|---|---|---|---|---|---|---|---|---|
| Diluent | — | 2.4 | 1.8 | 0.4 | — | 0.04 | 0.4 | 41.36 |
| Bitumen | — | 1.2 | 0.9 | 0.3 | — | 0.3 | 0.2 | 20.76 |
| Water | 149.58 | 27.4 | 17.8 | 9.8 | 8.5 | 10.62 | 70.9 | 2.1 |
| Solids | 3.0 | 14.3 | 0.7 | 13.6 | — | 13.6 | 2.72 | 0.3 |
| Total | 152.58 | 45.3 | 21.2 | 24.1 | 8.5 | 24.56 | 74.22 | 64.52 |

What is claimed:

1. A process for the substantially complete recovery of bituminous hydrocarbons from bituminous tar sands comprising:

(a) preconditioning the bituminous tar sands at a temperature of about 65° to 85° C. by admixing therewith a hydrocarbon diluent miscible with the bituminous hydrocarbons in a liquid/solid ratio of from 0.15 to 0.3 w/w at a water/solid ratio of less than about 0.2 w/w over sand for a period of time of from about 3 to 10 minutes to substantially fully disaggregate the solid materials, reduce the viscosity and density of the bituminous hydrocarbons, and homogenize the diluent with the bituminous hydrocarbons and solids, so that a preconditioning product comprising a substantially homogeneous pulp containing solids and hydrocarbons with no intermediate aqueous phase is obtained;

(b) digesting the preconditioning product from step (a) for from about 5 to 15 minutes at a temperature of from about 60° to 80° C. by gently mixing an aqueous liquid having a pH of about 7.5 to 10.5 with the preconditioning product in an amount sufficient to provide a digestion mass having a water/solids ratio of from about 0.3 to 1.5 w/w, said gentle mixing being of a force sufficient to impregnate the pulp solids with aqueous liquid and to substantially displace the hydrocarbons from the pulp but insufficient to breach the hydrocarbon/water interface being formed and to cause formation of hydrocarbon/water emulsions, so that a digestion product comprising a thickened solids phase containing solids, water and residual hydrocarbons, an intermediate aqueous phase, and a floating hydrocarbon phase containing primarily bituminous hydrocarbons and hydrocarbon diluent is obtained;

(c) separating the phases of the digestion product from step (b) and separately recovering the floating hydrocarbon phase and the thickened solids phase; and (d) separating the thickened solids phase from step (c) into a separation product comprising a hydrocarbon phase; an intermediate aqueous phase containing fines, clay and residual hydrocarbons; and a solid thickened phase comprising sand, water, and residual hydrocarbons; and recovering the hydrocarbon phase.

2. The invention of claim 1, wherein a bitumen extract is admixed with the bituminous tar sands along with the hydrocarbon diluent in step(a).

3. The invention of claim 2, wherein the bitumen extract comprises diluted bituminous hydrocarbons recycled from the floating hydrocarbon phase of the digestion product.

4. The invention of claim 1, wherein the solid thickened phase of the separation product is recovered and treated by washing with water without dispersing solids to coalesce and entrap hydrocarbon droplets to form a treated solids product comprising an aqueous phase containing entrapped hydrocarbon and fines, and a thickened solids phase comprising sand, water and residual hydrocarbons.

5. A process according to claim 4, in which the washing is carried out in such a way that the solids remain thickened without dispersion with an excess of washing water and that the surface of the solid bed exposed to the overfloating water is renewed enough times to permit the droplets, increased in size by coalescence, to separate by floating.

6. The invention of claim 4, wherein a portion of aqueous phase of the treated solids product is recycled to digestion step(b).

7. The invention of claim 4, wherein the thickened solids phase of the treated solids product is separated to recover residual hydrocarbons, drained sands, and aqueous liquid.

8. The invention of claim 1, wherein the intermediate aqueous phase of the separation product is recovered and clarified by separation of fines and clay.

9. The invention of claim 8, wherein a portion of the clarified intermediate aqueous phase is recycled.

10. The invention of claim 8, wherein the fines and clay present are separated by sedimentation and decantation to thicken the sedimented solids, and wherein the thickened sedimented solids are subsequently stripped to recover associated hydrocarbon.

11. The invention of claim 1, wherein the thickened solids phase of the digestion product, or the digestion product or preconditioning product is screened to remove large solids lumps.

12. The invention of claim 4, wherein the washing water and solid thickened phase are flowed countercurrently and the solids are kept in thickened phase without dispersion.

13. The invention of claim 1, wherein the pH of the aqueous liquid added in step (b) is between 8.5 and 9.5.

14. The invention of claim 4, wherein the aqueous phase of the treated solids product is separated from the thickened solids phase of the treated solids product, and the thickened solids phase is squeezed to coalesce residual hydrocarbons.

15. The invention of claim 1, wherein the thickened solids phase is separated by gravity sedimentation.

16. The invention of claim 10, wherein the thickened sedimented solids are centrifuged before stripping.

17. The invention of claim 4, wherein the solid thickened phase is treated by washing with water and mixing slowly and evenly in co- or countercurrent with the water so that the oil/water interface is not breached.

* * * * *